US005642841A

United States Patent [19]

Beaty

[11] Patent Number: 5,642,841

[45] Date of Patent: Jul. 1, 1997

[54] APPARATUS AND METHOD FOR HANGING A PLURALITY OF BOTH BELTS AND TIES

[76] Inventor: Terry Lewis Beaty, 3061 Chemehuevi Pl., Lake Havasu City, Ariz. 86406

[21] Appl. No.: 674,171

[22] Filed: Jul. 1, 1996

[51] Int. Cl.[6] ..... A47G 25/14

[52] U.S. Cl. ..... 223/85; 223/DIG. 1

[58] Field of Search ..... 223/85, DIG. 1, 223/DIG. 4; 211/113; D6/315, 327

[56] References Cited

U.S. PATENT DOCUMENTS

| | | | |
|---|---|---|---|
| D. 291,031 | 7/1987 | Luongo | D6/323 |
| 1,687,129 | 10/1928 | Henninger | 211/113 |
| 1,754,940 | 4/1930 | Freeman | 223/DIG. 1 |
| 2,793,762 | 5/1957 | Broussard | 223/DIG. 1 |
| 4,611,721 | 9/1986 | Heckaman | 211/100 |
| 4,834,248 | 5/1989 | Lee | 211/13 |
| 4,863,043 | 9/1989 | Bower | 211/113 |
| 5,209,382 | 5/1993 | Chang | 223/DIG. 1 |

*Primary Examiner*—Bibhu Mohanty

[57] ABSTRACT

A closet belt and tie hanger with plural rows and columns of dowels including a rectangular block having a long length, an intermediate height, and a short thickness with apertures in three parallel rows of eight columns extending therethrough, the apertures being separated by regular intervals; a cylindrical dowel in each aperture and extending from the block perpendicularly on each side; and a curved metal hanger hook projecting upwardly from the top of the rectangular block.

2 Claims, 2 Drawing Sheets

APPARATUS AND METHOD FOR HANGING A PLURALITY OF BOTH BELTS AND TIES

BACKGROUND OF THE INVENTION

1. Field of the Invention

The present invention relates to a apparatus and method for hanging a plurality of both belts and ties and more particularly pertains to hanging a large quantity of belts and ties in a closet without wrinkling the ties and further requiring minimal space.

2. Description of the Prior Art

The use of belt holders is known in the prior art. More specifically, belt holders heretofore devised and utilized for the purpose of storing belts are known to consist basically of familiar, expected and obvious structural configurations, notwithstanding the myriad of designs encompassed by the crowded prior art which have been developed for the fulfillment of countless objectives and requirements.

The prior art discloses various types of belt hangers. By way of example, U.S. Pat. No. 4,834,248 to Lee discloses a belt hanger.

U.S. Pat. No. 4,611,721 to Heckaman discloses a tie and belt rack.

U.S. Pat. No. 4,863,043 to Bowen discloses a rack for neckties, belts or other apparel.

U.S. Pat. No. 318,378 to Baekgaard, Sr. discloses an ornamental design for a combined tie rack and belt hanger.

U.S. Pat. No. 291,031 to Luongo discloses an ornamental design for a combined tie and belt rack.

In this respect, the apparatus and method for hanging a plurality of both belts and ties according to the present invention substantially depart from the conventional concepts and designs of the prior art, and in doing so provide an apparatus primarily developed for the purpose of hanging a large quantity of belts and ties in a closet without wrinkling the ties.

Therefore, it can be appreciated that there exists a continuing need for a new and improved apparatus and method for hanging a plurality of both belts and ties which can be used for hanging a large quantity of belts and ties in a closet without wrinkling the ties. In this regard, the present invention substantially fulfills this need.

SUMMARY OF THE INVENTION

In view of the foregoing disadvantages inherent in the known types of belt holders now present in the prior art, the present invention provides an improved apparatus and method for hanging a plurality of both belts and ties. As such, the general purpose of the present invention, which will be described subsequently in greater detail, is to provide a new and improved apparatus and method for hanging a plurality of both belts and ties which has all the advantages of the prior art and none of the disadvantages.

To attain this, the present invention essentially comprises a plurality of belts each with a first end having a buckle situated thereon and second end; a plurality of ties each with a first end having a pair of thick end portions and an intermediate thin portion; a rectangular block having a long length of about twelve inches, an intermediate height of about three and one-half inches, and a short thickness of about one inch with apertures in three parallel rows of eight columns extending therethrough, the apertures being separated by regular intervals; a cylindrical dowel having a length of less than four inches, each dowel coupled in each aperture and extending from the block perpendicularly on each side thus defining three parallel rows of eight columns of less than 1 and ½ inch posts for allowing the belts and ties to be serpentinely situated between the rows; and a curved metal hanger hook pivotally coupled to the block and projecting upwardly therefrom for placement thereof in a closet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus and method for hanging a plurality of both belts and ties which has all the advantages of the prior art belt holders and none of the disadvantages.

It is another object of the present invention to provide a new and improved apparatus and method for hanging a plurality of both belts and ties which may be easily and efficiently manufactured and marketed.

It is a further object of the present invention to provide a new and improved apparatus and method for hanging a plurality of both belts and ties which is of a durable and reliable construction.

An even further object of the present invention is to provide a new and improved apparatus and method for hanging a plurality of both belts and ties which is susceptible of a low cost of manufacture with regard to both materials and labor, and which accordingly is then susceptible of low prices of sale to the consuming public, thereby making such apparatus and method for hanging a plurality of both belts and ties economically available to the buying public.

Still yet another object of the present invention is to provide a new and improved apparatus and method for hanging a plurality of both belts and ties which provides in the apparatuses and methods of the prior art some of the advantages thereof, while simultaneously overcoming some of the disadvantages normally associated therewith.

Yet another object of the present invention is to provide a hanging mechanism that can accommodate both a tie and a belt.

Another object of the present invention is to require minimal space when utilized within a closet.

Still another object of the present invention is to hang a large quantity of belts and ties in a closet without wrinkling the ties.

Yet another object of the present invention is to provide a hanging mechanism which is capable of containing ties as effectively as prior methods but without wrinkling.

Still yet another object of the present invention is to provide a unique method of hanging both ties and belts on a similar structure.

Lastly, it is an object of the present invention to provide a new and improved closet belt and tie hanger with plural rows and columns of dowels including a rectangular block having a long length, an intermediate height, and a short thickness with apertures in three parallel rows of eight columns extending therethrough, the apertures being separated by regular intervals; a cylindrical dowel in each aperture and extending from the block perpendicularly on each side; and a curved metal hanger hook projecting upwardly from the top of the rectangular block.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
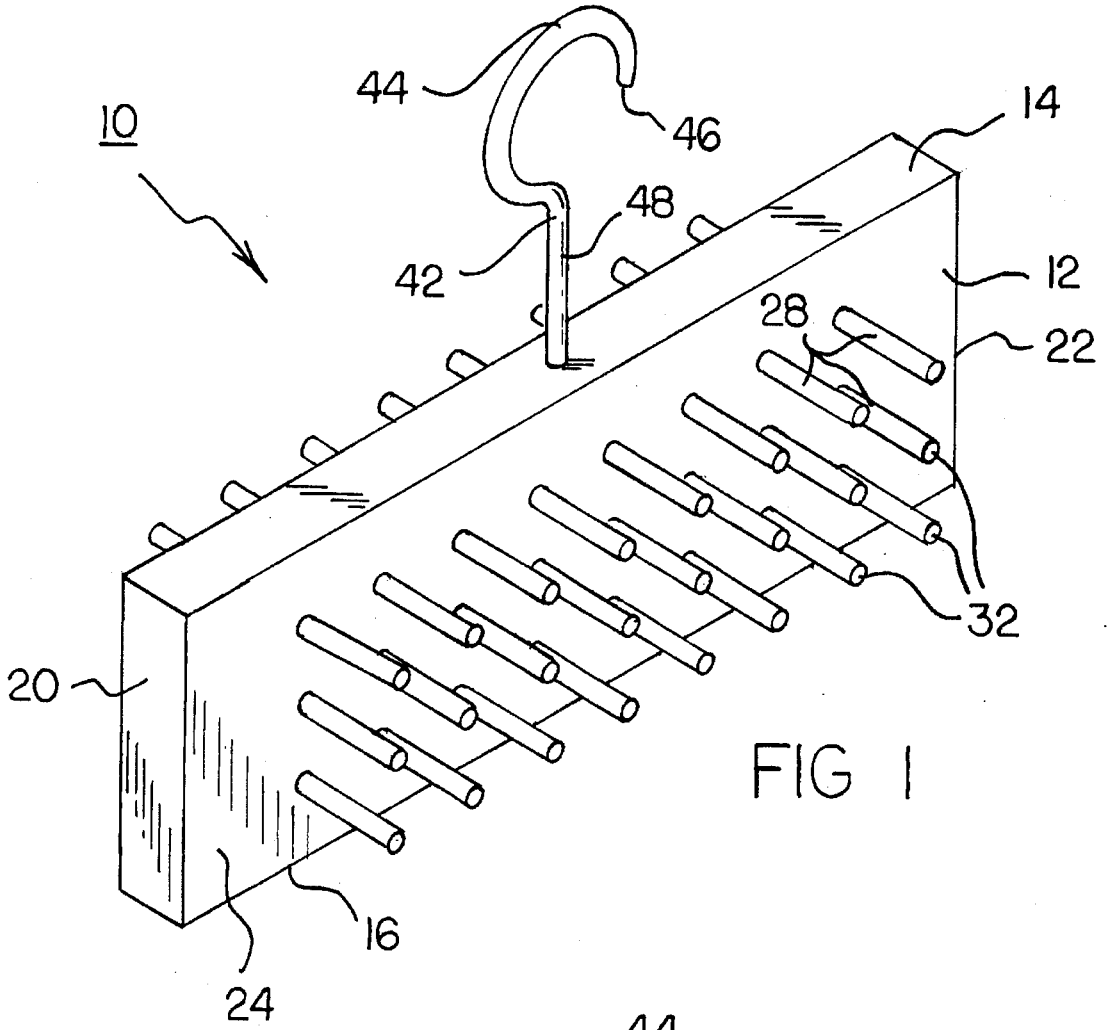
FIG. 1 is a perspective view of the preferred embodiment of the closet belt and tie hanger with plural rows and columns of dowels constructed in accordance with the principles of the present invention.
Figure 2:
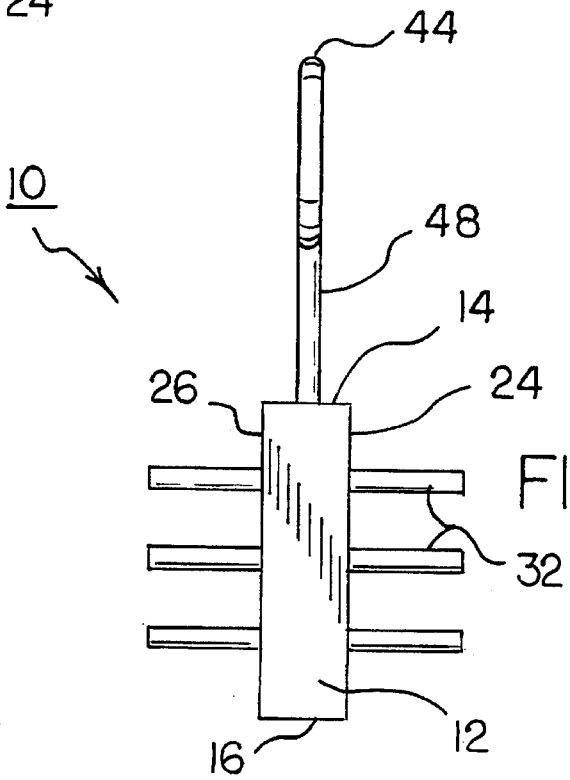
FIG. 2 is an end elevational view of the closet belt and tie hanger with plural rows and columns of dowels of FIG. 1.

With reference now to the drawings, and in particular to FIG. 1 thereof, a new and improved apparatus and method for hanging a plurality of both belts and ties embodying the principles and concepts of the present invention and generally designated by the reference numeral 10 will be described.

Specifically, it will be noted in the FIGS. 1 through 4 that there is provided a new and improved closet belt and tie hanger with plural rows and columns of dowels. In its broadest context, the invention includes a rectangular block, dowels extending through the block and a curved hanger projecting upwardly from the top of the block. These individual components are specifically configured and correlated one with respect to the other to attain the desired objective.

Figure 3:
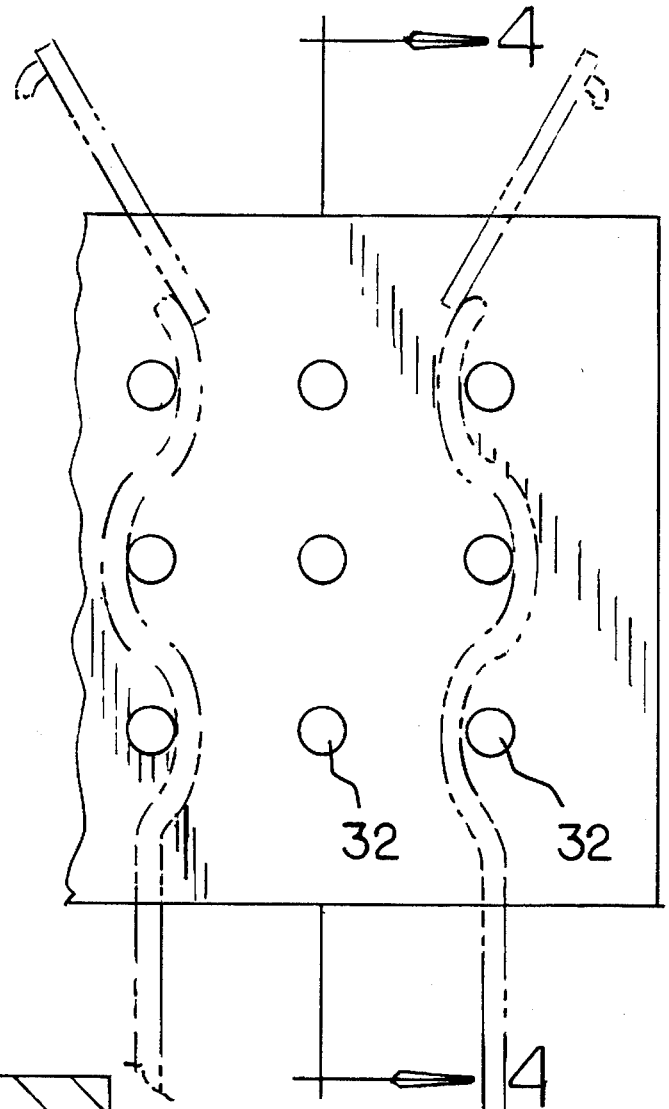
FIG. 3 is an enlarged fragmentary front elevational view of the device of FIGS. 1 and 2.
Figure 4:
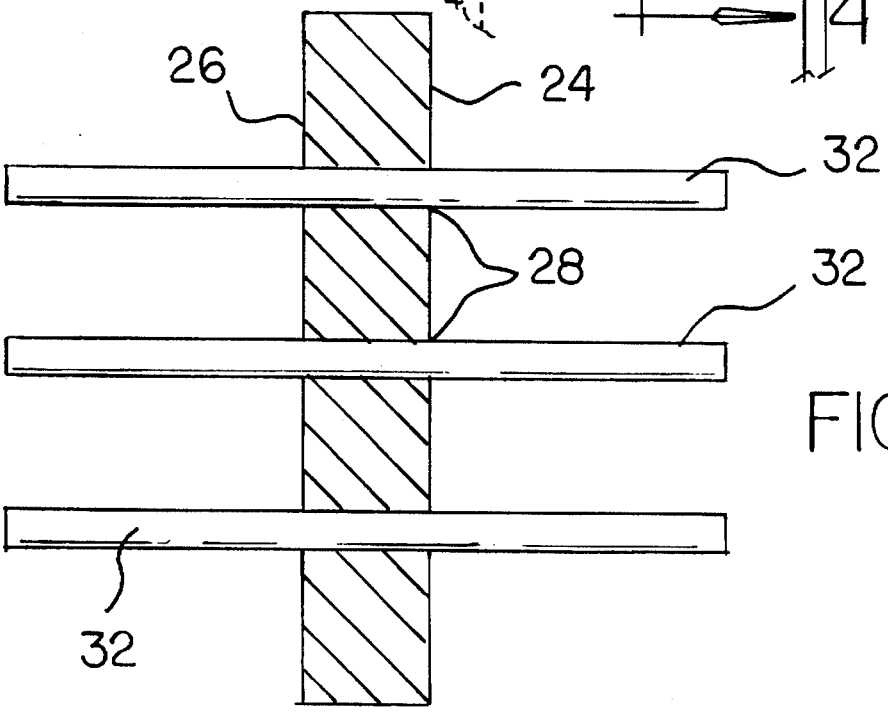
FIG. 4 is an cross-sectional end view of the device of the prior Figures illustrating the dowels traversing the rectangular main body.

More specifically, the system 10 includes a plurality of belts, as shown in FIG. 3. Each belt has a first end having a buckle situated thereon and further a second end. Also included is a plurality of ties each with a pair of thick end portions and an intermediate thin portion. As such, two halves are situated between the intermediate portion and each of the thick ends.

As shown in FIG. 1, a block is included having a long length of about twelve inches at its parallel upper and lower edges 14 and 16. It has an intermediate height of about three and one-half inches along its parallel side edges 20 and 22 and it has a short thickness of about one inch at its front and rear faces 24 and 26. Centrally located through the front and rear faces 24 and 26 are apertures 28 with circular cross-sections. In the preferred embodiment, three parallel rows of apertures are provided with eight columns of 3 rows. Such apertures extend through the block from face to face for the receipt of dowels as will be described hereinafter. The apertures are separated by regular intervals horizontally and vertically. Ideally, such horizontal intervals are approximately between 1 and 1 and ½ inches in length and the vertical intervals are approximately ¾ of an inch.

The next major component of the system is a plurality of cylindrical dowels 32 having circular cross-sections. Each of the dowels is positioned in an associated aperture. The dowels are less than four inches in length and are each centrally positioned through its associated hole to extend from the block perpendicularly. As such, three parallel rows of eight columns of less than 1 and ½ inch posts are defined. Also, a 3 to 2 ratio is defined between the length of the each post and the thickness of the block. It should be note that aforementioned ratio is critical since if only one side of the block were utilized, a tipping effect would otherwise occur thus releasing the belts and ties.

The next major component of the system is a hanger hook 42. The hanger hook is pivotally coupled to the block and projected upwardly therefrom. The hanger hook has a curved upper extent 44 with an opening 46 for placing it on the bar of a horizontal cross bar in a closet or other similar location. The lower extent of the hanger hook is a linear extent 48 terminating in the central extent of the upper edge of the block.

The method associated with the present invention is made possible by the inclusion of the aforementioned structure. In use, a user may situate each of the ties within one of the columns of posts such that one of the halves thereof is serpentinely positioned between the posts. The intermediate thin portion of the tie is wrapped about a top post of the column. The other half of the tie is then hung loosely. The present invention thus does not require a clip or the like to obtain optimal securement of the tie to the block. Also, the present invention does not crease the tie as a clip would.

The method further includes situating each of the belts within one of the columns of posts such that the belt is serpentinely positioned between the posts. It is important that the buckle of the belt is situated adjacent a top post of the column and further angled slightly offset from a vertical axis. By doing this, the belt is partially wrapped about the top post, whereby the weight of the buckle of the first end precludes the release of the belt.

To optimize space within the closet, the pivoting nature of the hanger hook may be exploited. For example the block may be pivoted with respect to the cross bar of the closet prior to situating the ties and belts. The result of such pivoting positions the posts perpendicular to the cross bar thus allowing convenient access thereto by a user. In addition, the block may be pivoted again with respect to the cross bar of the closet after situating the ties and belts. After such pivoting, the posts are parallel with the cross bar thus requiring minimal space within the closet.

The present invention offers a convenient way for people to hang their belts and ties in closets. Note FIG. 3. It is designed to hang next to the user's clothes and has a curved hanger hook on top for this purpose. For people who have many different belts and ties that they would like to hang all together, the present invention is the perfect solution. The present invention makes a lot of sense for anyone, male or female, who has many belts and ties and would like to find a more efficient way to organize them.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A closet belt and tie hanger with plural rows and columns of dowels comprising, in combination:

a closet with a cross bar situated therein;

a plurality of belts each with a first end having a buckle situated thereon and second end;

a plurality of ties each with a first end having a pair of thick end portions and an intermediate thin portion thus defining two halves situated between the intermediate portion and each of the thick ends;

a rectangular block having a long length of about twelve inches, an intermediate height of about three and one-half inches, and a short thickness of about one inch with circular apertures in three parallel rows of eight columns extending therethrough, the apertures being separated by regular horizontal intervals and vertical intervals, wherein the horizonal intervals are approximately 1 and ½ inches and the vertical intervals are approximately ¾ of an inch;

a plurality of cylindrical dowels having a length of less than four inches, each dowel coupled in each aperture and extending from the block perpendicularly on each side thus defining three parallel rows of eight columns of less than 1 and ½ inch posts for allowing the belts and ties to be serpentinely situated between the rows, wherein the length of the post forms a 3 to 2 ratio with respect to the thickness of the block; and a curved metal hanger hook pivotally coupled to the block and projecting upwardly therefrom for placement thereof in a closet, the metal hanger having a lower linear extent and a curved upper extent with an opening for the placement thereof on the cross bar of the closet;

wherein each of the ties may be situated on one of the columns of the posts wherein one of the halves thereof is situated serpentinely between the posts of the column and further the belts may be situated sertpentinely between another of the columns of the posts wherein the buckle of the belt is situated adjacent a top post of the column and further angled slightly offset from a vertical axis.

2. A method of hanging both ties and belts without wrinkling the ties including the steps of:

providing a closet with a cross bar situated therein;

providing a plurality of belts each with a first end having a buckle situated thereon and a second end;

providing a plurality of ties each with a pair of thick end portions and an intermediate thin portion thus defining two halves situated between the intermediate portion and each of the thick ends;

providing a rectangular block having a long length of about twelve inches, an intermediate height of about three and one-half inches, and a short thickness of about one inch with circular apertures in three parallel rows of eight columns extending therethrough, the apertures being separated by regular horizontal intervals and vertical intervals, wherein the horizonal intervals are approximately 1 and ½ inches and the vertical intervals are approximately ¾ of an inch;

providing a plurality of cylindrical dowels having a length of less than four inches, each dowel coupled in each aperture and extending from the block perpendicularly on each side thus defining three parallel rows of eight columns of less than 1 and ½ inch posts, wherein the length of the post forms a 3 to 2 ratio with respect to the thickness of the block;

providing a curved metal hanger hook pivotally coupled to the block and projecting upwardly therefrom for placement thereof on a horizontally orientated cross bar of a closet, the metal hanger having a lower linear extent and a curved upper extent with an opening for the placement thereof on the cross bar of the closet;

situating each of the ties within one of the columns of posts such that one of the halves thereof is serpentinely positioned between the posts with the intermediate thin portion wrapped about a top post of the column and further the other half of the tie is hung loosely; and situating each of the belts within one of the columns of posts such that the belt is serpentinely positioned between the posts with the buckle thereof situated adjacent a top post of the column and further angled slightly offset from a vertical axis so that the belt partially wraps about the top post, whereby the weight of the buckle of the first end precludes the release of the belt;

pivoting the block with respect to the cross bar of the closet prior to situating the ties and prior to situating the belts such that the posts are perpendicular to the cross bar thus allowing convenient access thereto by a user; and pivoting the block with respect to the cross bar of the closet after situating the ties and after situating the belts such that the posts are parallel with the cross bar thus requiring minimal space within the closet.

* * * * *